US008127369B2

(12) United States Patent
Bigalke

(10) Patent No.: US 8,127,369 B2
(45) Date of Patent: Mar. 6, 2012

(54) KNEE-MOUNTED AIR DEFLECTOR FOR MOTORCYCLIST

(76) Inventor: Jerry H. Bigalke, Stevens Point, WI (US)

( * ) Notice: Subject to any disclaimer, the term of this patent is extended or adjusted under 35 U.S.C. 154(b) by 583 days.

(21) Appl. No.: 12/288,244

(22) Filed: Oct. 17, 2008

(65) Prior Publication Data

US 2010/0095440 A1 Apr. 22, 2010

(51) Int. Cl.
*A41D 13/00* (2006.01)

(52) U.S. Cl. ..... 2/62

(58) Field of Classification Search ..... 2/22, 23, 2/24, 16, 455, 242, 908, 911; 128/878, 882; 296/180.1
See application file for complete search history.

(56) References Cited

U.S. PATENT DOCUMENTS

| | | | | |
|---|---|---|---|---|
| 3,901,549 | A | 8/1975 | Ramirez | 296/78.1 |
| 4,457,552 | A | 7/1984 | Katsuoka | 296/78.1 |
| 5,031,240 | A * | 7/1991 | Nierhaus | 2/24 |
| 5,452,475 | A | 9/1995 | Hunt, Jr. | 2/22 |
| 5,469,637 | A * | 11/1995 | Adam | 36/2 R |
| 5,829,055 | A * | 11/1998 | Collins et al. | 2/22 |
| 5,845,336 | A | 12/1998 | Golde | 2/93 |
| 6,102,149 | A | 8/2000 | Suzuki et al. | 180/229 |
| 6,263,510 | B1 | 7/2001 | Bay et al. | 2/93 |
| 6,317,888 | B1 * | 11/2001 | McFarlane | 2/24 |
| 6,553,573 | B1 * | 4/2003 | Brown | 2/24 |
| 6,637,034 | B1 * | 10/2003 | Worden | 2/24 |
| 6,807,682 | B1 * | 10/2004 | Shircliff | 2/24 |
| 7,178,858 | B1 | 2/2007 | Hesse | 296/180.1 |
| 7,690,048 | B2 * | 4/2010 | Brandt | 2/22 |
| 2004/0244087 | A1 | 12/2004 | Halterman | 2/15 |
| 2007/0066210 | A1 | 3/2007 | Ueda et al. | 454/125 |

* cited by examiner

*Primary Examiner* — Tejash Patel
(74) *Attorney, Agent, or Firm* — Patentability Associates

(57) ABSTRACT

An air deflector is mounted to the area of the knee of a motorcyclist to prevent a stream of air from striking the motorcyclist's face. In one embodiment, the deflector is in the form of a cap visor.

13 Claims, 9 Drawing Sheets

KNEE-MOUNTED AIR DEFLECTOR FOR MOTORCYCLIST

BACKGROUND OF THE INVENTION

A serious problem for motorcyclists is that a blast of air impacts their neck, face and eyes while they are moving. This problem is illustrated in FIG. 1, which is a side view of a motorcyclist 10 on a motorcycle 12. As shown, an air stream 14 flows below the windshield 16, up the front side of the torso of motorcyclist 10 and hits the neck and face of motorcyclist 10. This air stream is annoying, particularly on long journeys. It is also noisy and may carry bugs and rain drops. Most importantly, the air stream presents a safety hazard, as it may distract the motorcyclist's attention from the road and from other vehicles.

U.S. Published Application No. 2004/0244087 suggests blocking this air stream with a deflector worn on the chest of the motorcyclist. This solution is not satisfactory, in part because a chest-worn deflector may impair the movement of the upper body and arms of the motorcyclist. In addition, the deflector cannot be easily removed and is unsightly. If mounted to a jacket, the jacket must be made of heavy material and fit tightly enough to hold the deflector in place during operation. This may uncomfortable, particularly in warm weather.

BRIEF SUMMARY OF THE INVENTION

These problems are solved with a deflector of this invention. According to this invention, a forward-extending deflector is mounted to the area of the knees of the motorcyclist. The deflector extends into the air stream and effectively prevents a large portion of the air stream from reaching the neck, face and eyes of the motorcyclist. The deflector of this invention does not interfere with the movement of the motorcyclist's arms and other upper body parts.

The deflector may be formed in a variety of sizes and shapes. In one embodiment, for example, the deflector is in the form of a visor of a cap. The deflector may be strapped to the legs of the motorcyclist. Typically, the deflector extends in a forward direction about 3-5 inches.

This invention also includes a method of blocking an air stream from the neck and face of a motorcyclist by mounting a deflector to the motorcyclist's knees.

DETAILED DESCRIPTION OF THE INVENTION

Figure 1:
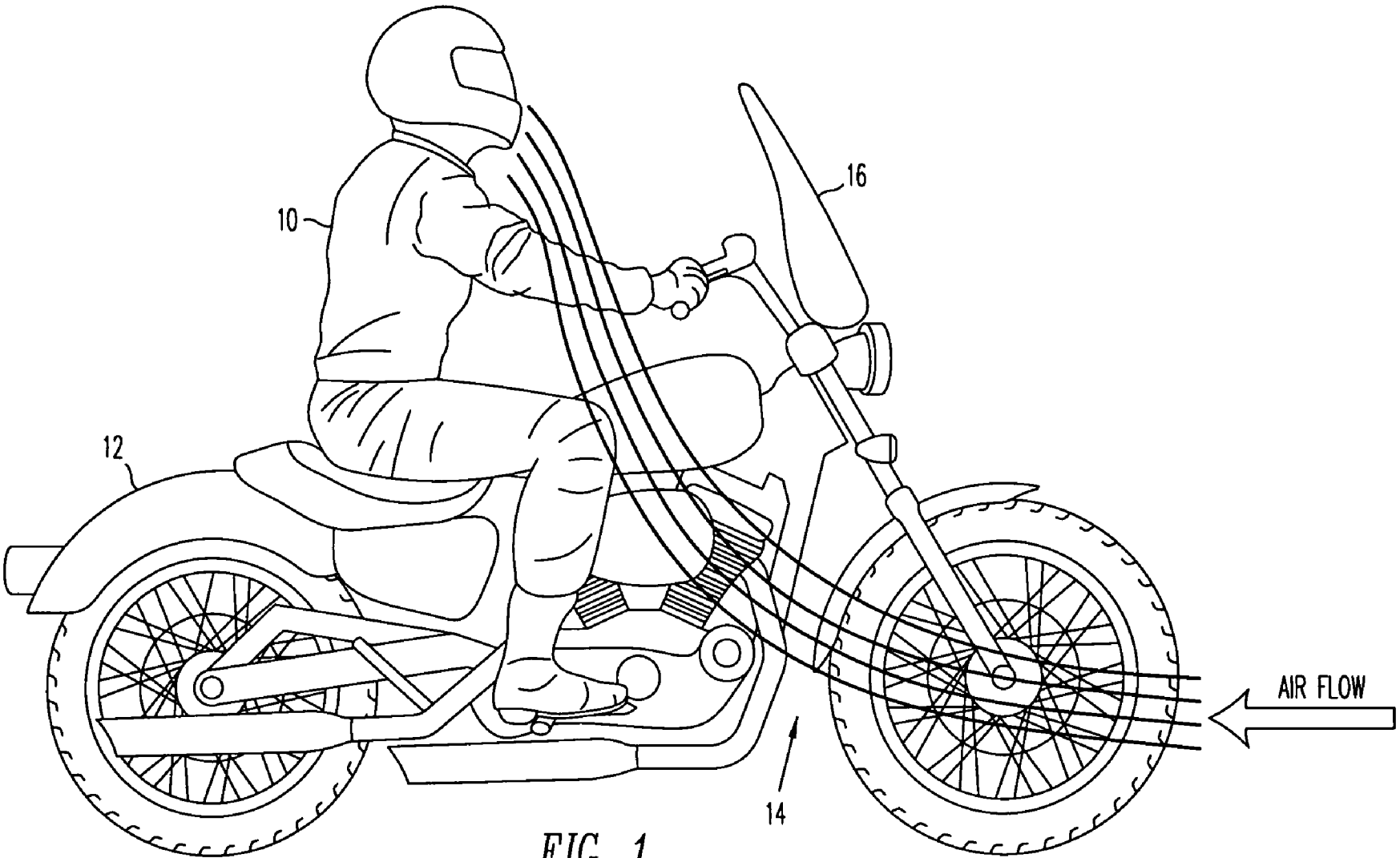
FIG. 1 (Prior Art)
FIG. 1 is side view illustrating how an air stream flows against the face and neck of a motorcyclist.
Figure 2:
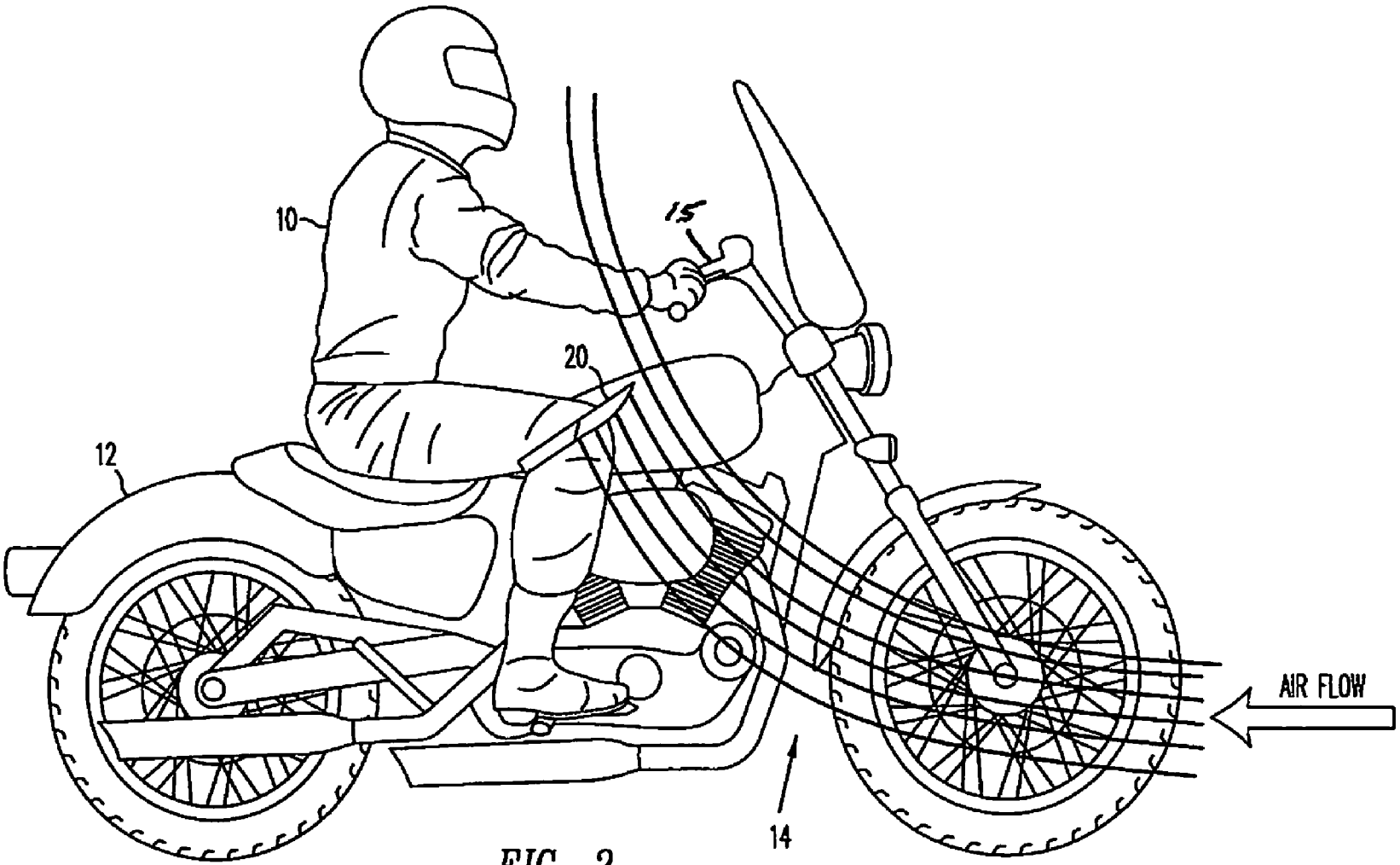
FIG. 2 is a side view of a deflector of this invention mounted to the knee of a motorcyclist.

FIG. 2 illustrates a deflector 20 of this invention. Deflector 20 is mounted to the knee of rider 10 and protrudes forward into air stream 14 in the general direction of a handlebar 15. As shown, deflector 20 deflects air stream 14 and thereby prevents a large part of air stream 14 from impacting the neck and face of rider 10.

Figure 3:
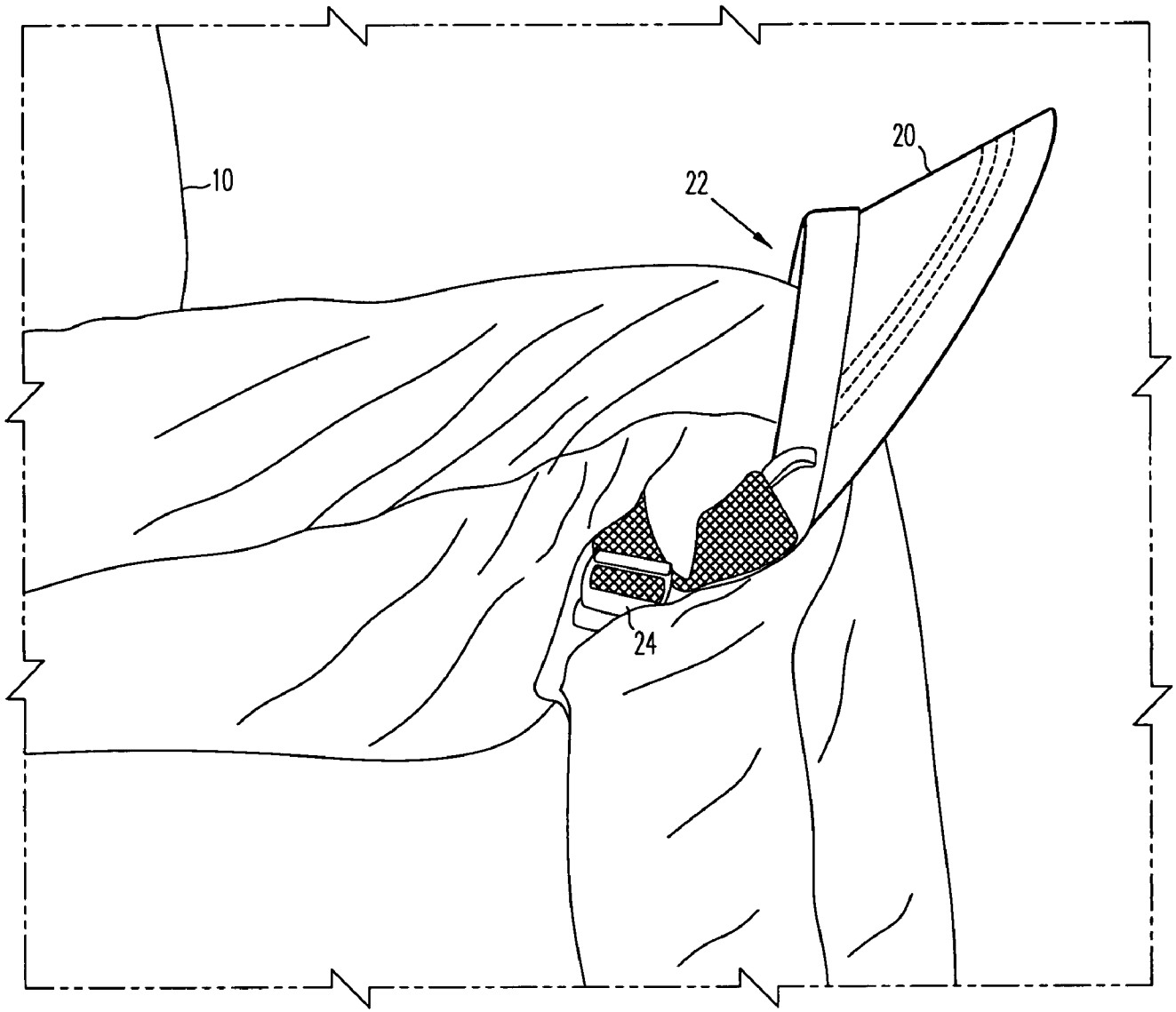
FIG. 3 is a close-up side view of the deflector mounted to the knee.
Figure 4:
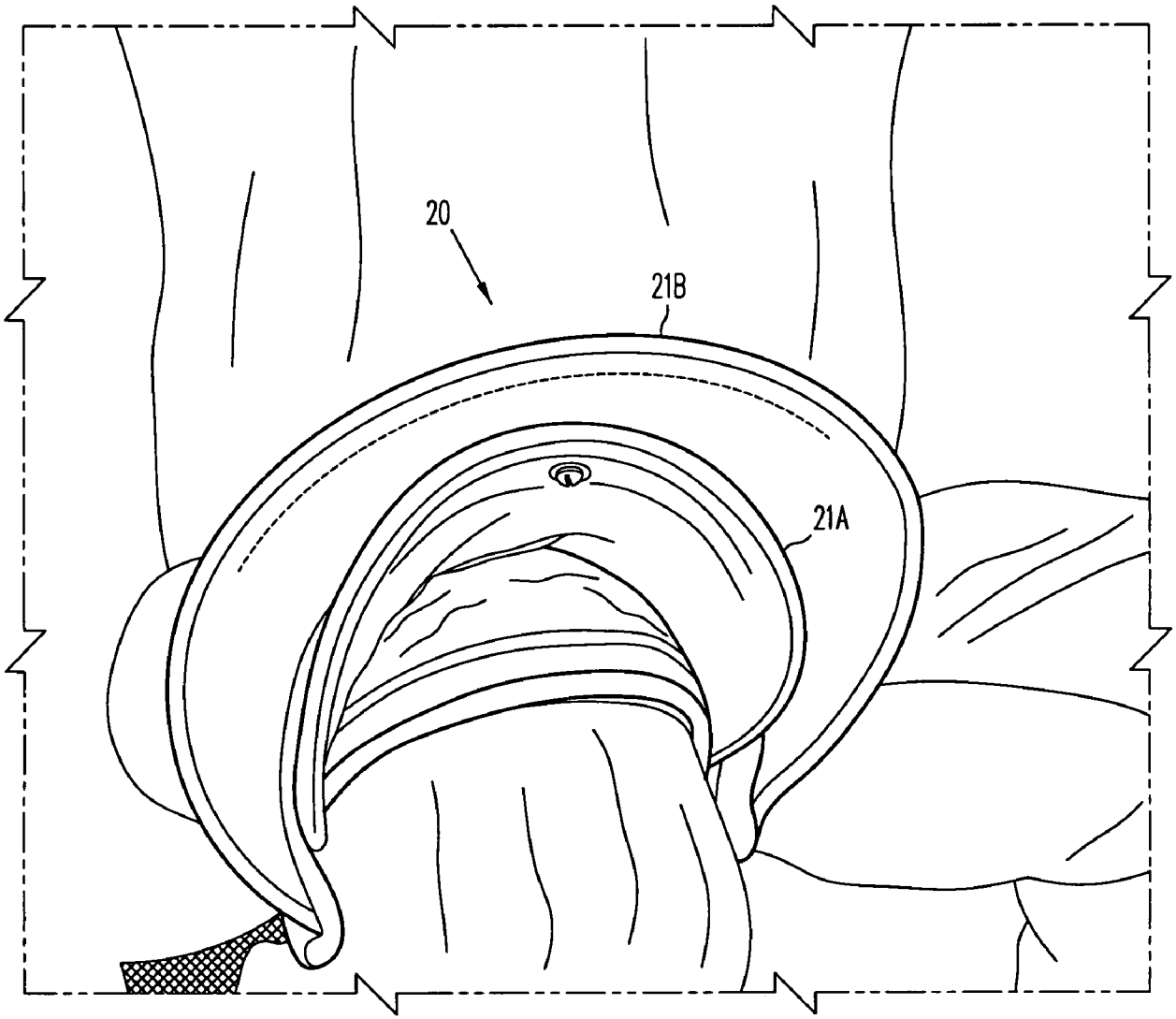
FIG. 4 is a close-up front view of the deflector mounted to the knee.

FIG. 3 is a more detailed view showing that deflector 20 is in the form of a cap visor and mounted to the knee 22 of motorcyclist 10 by means of a strap 24. FIG. 4 is a front view of the deflector 20 mounted to the motorcyclist's knee. Preferably, deflector 20 is mounted against the knee cap of motorcyclist 10 but it could also be mounted slightly above or slightly below the knee cap. As shown in FIG. 4, deflector 20 contains an inner cap visor 21A, which is fastened to the outer cap visor 21B in some manner (e.g., by stitching or gluing) to increase the extension of deflector 20, thereby allowing deflector 20 to block more air. The extension of deflector 20 in this embodiment is about 5 inches.

Figure 5:
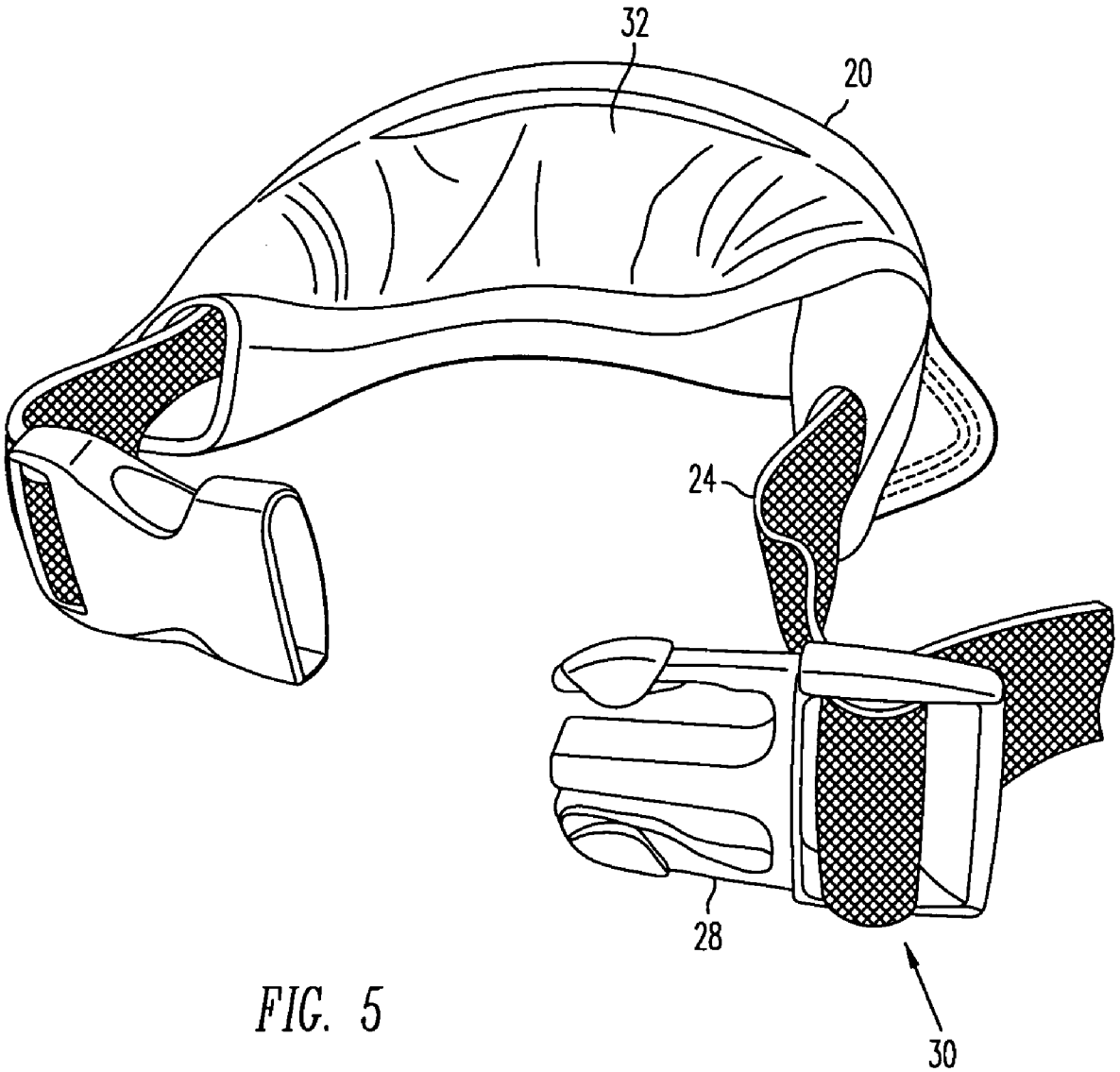
FIG. 5 is a detailed view of the defector showing the strap used to mount it to a knee.

FIG. 5 illustrates deflector 20 alone, showing strap 24 with a buckle 28, allowing deflector 20 to be easily mounted to and removed from the knee area of motorcyclist 10. As shown, strap 24 is looped back against itself through an opening 30 in buckle 28, making the length of strap 24 adjustable to fit the leg of the motorcyclist. Deflector 20 includes a mounting surface 32 which presses firmly against the knee of the motorcyclist when buckle 28 is secured.

Figure 6:
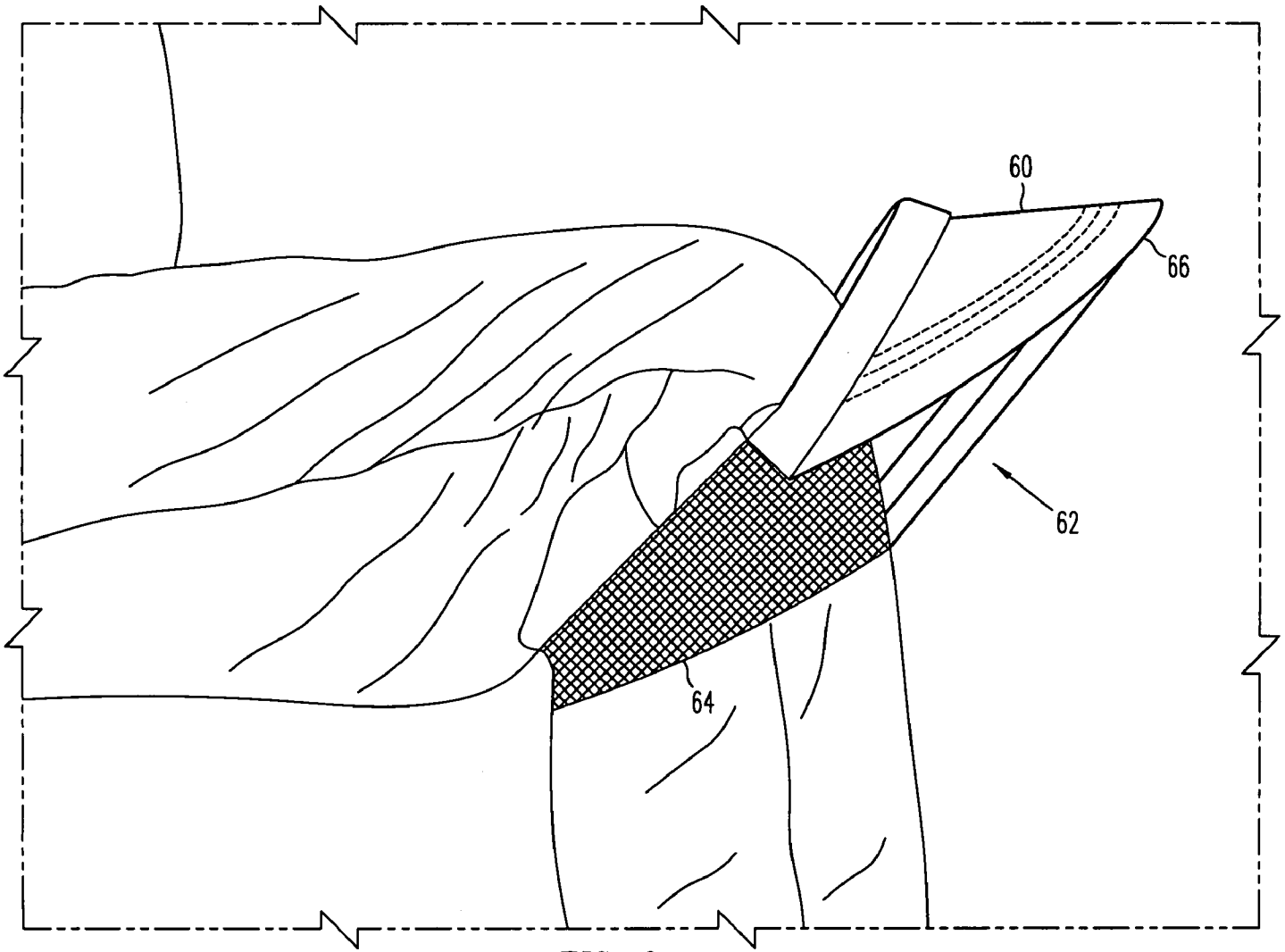
FIG. 6 is a close-up side view of the deflector with links to provide it with support against the air stream.

The defector 60 shown in FIG. 6 is similar to deflector 20 except that defector 60 contains links 62 extending from strap 64 to visor 66 to prevent visor 66 from being forced backward by the force of the air stream. Links 62 could be in the form of strings, elastic thread or a webbing.

Figure 7C:
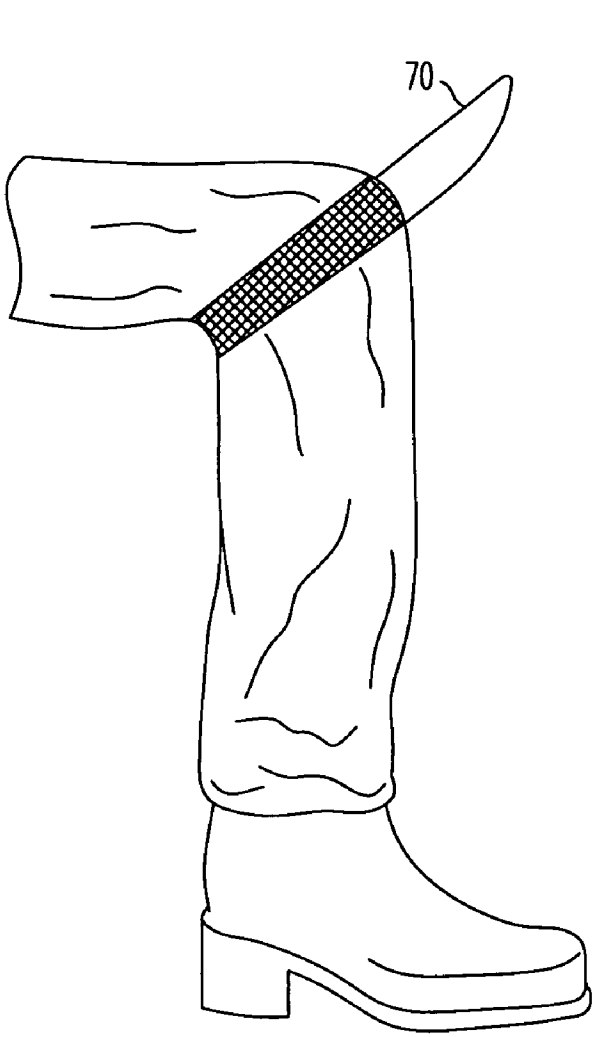
FIGS. 7A-7C illustrate a collapsible deflector that lies flat against the motorcyclist's leg when not in use.
Figure 7B:
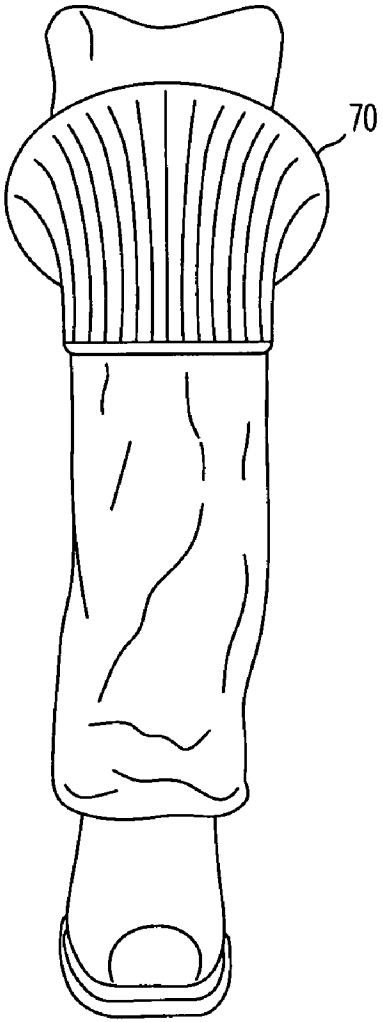
Figure 7A:
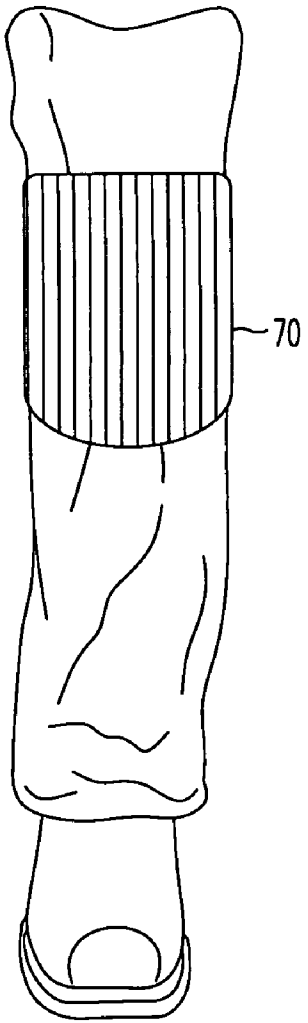

A possible problem with air deflectors is that they can be cumbersome and unsightly. FIGS. 7A, 7B and 7C illustrate a collapsible deflector 70. Deflector 70 is pleated so that it folds down against the leg of the motorcyclist when it is not being used to block an air stream. FIG. 7A shows deflector 70 in its collapsed condition, lying downward against the motorcyclist's leg. FIG. 7B is a front view of deflector 70 in its open condition when is it blocking an air stream. FIG. 7C is a side view of deflector 70 in its open condition.

Figure 8:
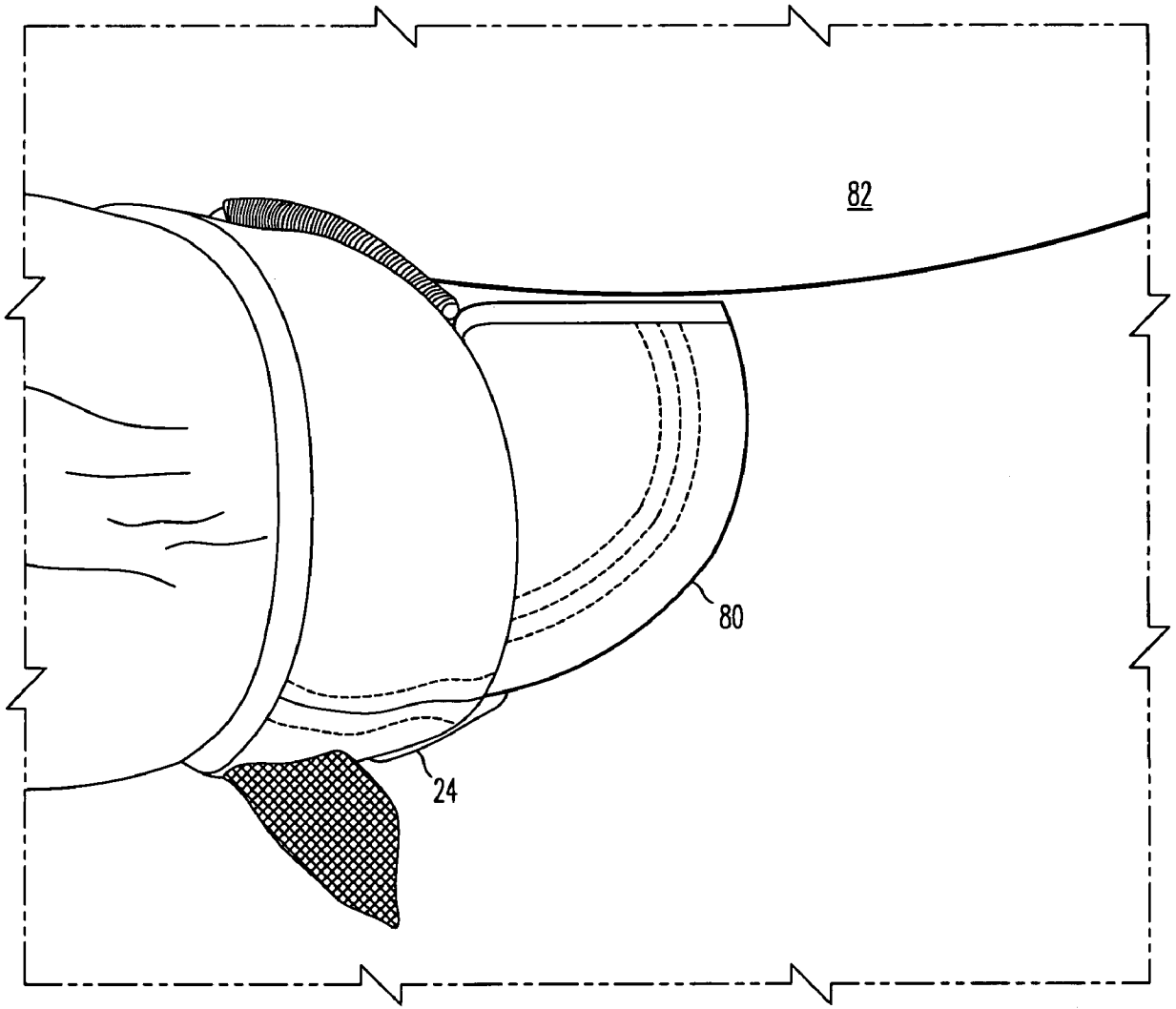
FIG. 8 is a top view of a deflector in the form of a half-visor.

FIG. 8 shows a top view of a deflector 80 that is in the shape of a half-visor, allowing deflector to fit snugly against the gas tank 82 and improving the efficiency of deflector 80 in blocking air. Typically, deflector 80 extends about 4 inches from the strap 24.

Figure 9B:
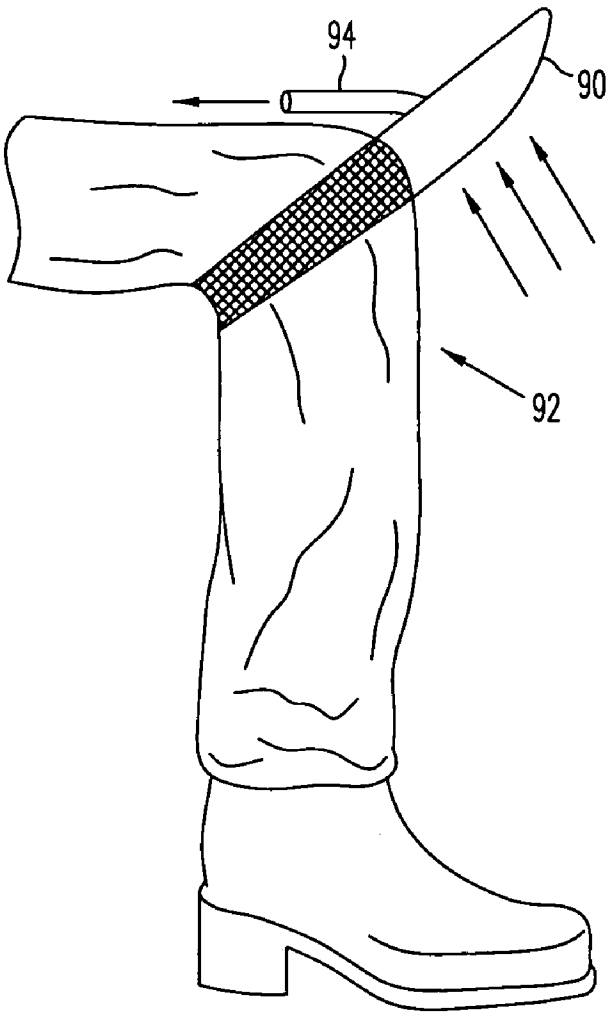
FIGS. 9A and 9B show a perforated deflector.
Figure 9A:
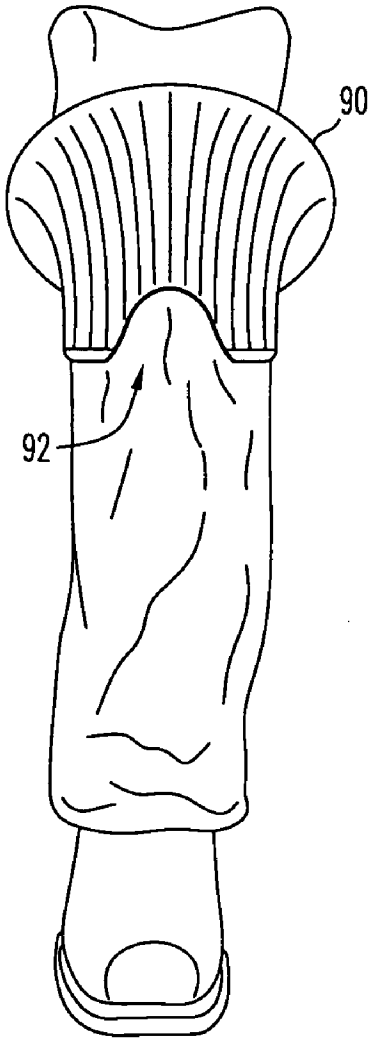

In some cases, it may be desirable to perforate the defector. FIGS. 9A and 9B illustrate deflector 90 that has a hole 92 adjacent the knee 22 of the motorcyclist. A tube 94 extends backward from hole 92 and to the side so as to direct the air that flows through hole 92 away from the face of the motorcyclist.

The embodiments of this invention described above are illustrative and not limiting. Many different and alternative embodiments will be apparent from the above descriptions. For example, while the deflectors described above are mounted to the motorcyclist's leg by means of a strap, it is also possible to mount the deflector by sewing it or otherwise attaching it to the motorcyclist's pants. The following claims are to be interpreted broadly to include all such alternative embodiments.

I claim:

1. An air deflector mounted to the knee of a motorcyclist, the motorcyclist being seated in a riding position on a motorcycle, the air deflector protruding forward from the knee of the motorcyclist in the general direction of a handlebar so as to deflect an air stream flowing up the front side of the torso of the motorcyclist and thereby prevent at least a part of the air stream from impacting the face of the motorcyclist.

2. The air deflector of claim 1 wherein the air deflector is in the form of a cap visor.

3. The air deflector of claim 2 wherein the air deflector is attached to the knee of the motorcyclist with a strap.

4. The air deflector of claim 3 wherein the visor is supported by links extending from the strap to the visor.

5. The air deflector of claim 1 wherein the air deflector is in the shape of a half visor.

6. The air deflector of claim 1 wherein the air deflector is collapsible such that the air deflector folds downward against the motorcyclist's leg in its collapsed condition.

7. The air deflector of claim 6 wherein the air deflector is pleated.

8. The air deflector of claim 1 wherein the air deflector comprises a hole.

9. The air deflector of claim 8 wherein the deflector comprises a tube extending backward from the hole.

10. A method of preventing an air stream from striking the face of a motorcyclist, the motorcyclist being mounted in a riding position on a motorcycle, the air stream flowing up the front side of the torso of the motorcyclist towards the face of the motorcyclist, the method comprising mounting an air deflector to the knee of the motorcyclist, the air deflector protruding forward from the knee of the motorcyclist in the general direction of a handlebar and deflecting the air stream so as to prevent the air stream from striking the face of the motorcyclist.

11. The method of claim 10 wherein the air deflector is in the form of a cap visor.

12. The method of claim 11 wherein the air deflector is mounted to the knee of the motorcyclist with a strap.

13. A motorcyclist seated in a riding position on a motorcycle, an air stream flowing up the front side of the motorcyclist towards the face of the motorcyclist, and a means for preventing the airstream from striking the face of the motorcyclist, said means being mounted to a knee of the motorcyclist and protruding forward generally in the direction of a handlebar.

* * * * *